US005713493A

United States Patent [19]

Garibaldi

[11] Patent Number: 5,713,493

[45] Date of Patent: Feb. 3, 1998

[54] CAP WITH ROTATABLE SKIRT FOR DISPENSING FLUIDS

[75] Inventor: Giuseppe Garibaldi, Milan, Italy

[73] Assignee: CAPSOL S.R.L., Milan, Italy

[21] Appl. No.: 714,422

[22] Filed: Sep. 16, 1996

[30] Foreign Application Priority Data

Oct. 12, 1995 [IT] Italy ..... MI95A2083

[51] Int. Cl.[6] ..... B67D 5/33

[52] U.S. Cl. ..... 222/153.06; 222/521; 222/507

[58] Field of Search ..... 222/153.06, 153.14, 222/521, 525, 541.5, 505; 272/507

[56] References Cited

U.S. PATENT DOCUMENTS

| | | | |
|---|---|---|---|
| 5,421,487 | 6/1995 | Moretti | 222/521 |
| 5,431,305 | 7/1995 | Kaminski . | |
| 5,472,120 | 12/1995 | Stebick et al. | 222/153.06 |
| 5,588,562 | 12/1996 | Sander et al. | 222/153.06 |

FOREIGN PATENT DOCUMENTS 0 342 109 11/1989 European Pat. Off. .

*Primary Examiner*—Philippe Derakshani
*Attorney, Agent, or Firm*—Oblon, Spivak, McClelland, Maier & Neustadt, P.C.

[57] ABSTRACT

A cap with a rotatable skirt (1), applicable to the mouth (6) of a container (7) for a fluid dispensable via the cap, which can also act as a closure cap. The cap comprises a skirt (1) rotatable on the mouth (6) of the container (7) and defines a cavity housing a hollow body (2) connected to the skirt (1) by breakable teeth (4), the skirt (1) and the hollow body (2) being formed in one piece by moulding. Between the skirt (1) and the hollow body (2) there extends an axially translatable cup-shaped body (3) connected to the skirt (1) by a disc (19) housed in a seat (21) provided on the top of the skirt (1), this disc (19) being moulded in one piece with the cup-shaped body (3), to which it is connected by breakable teeth (20).

2 Claims, 2 Drawing Sheets

CAP WITH ROTATABLE SKIRT FOR DISPENSING FLUIDS

Figure 1:
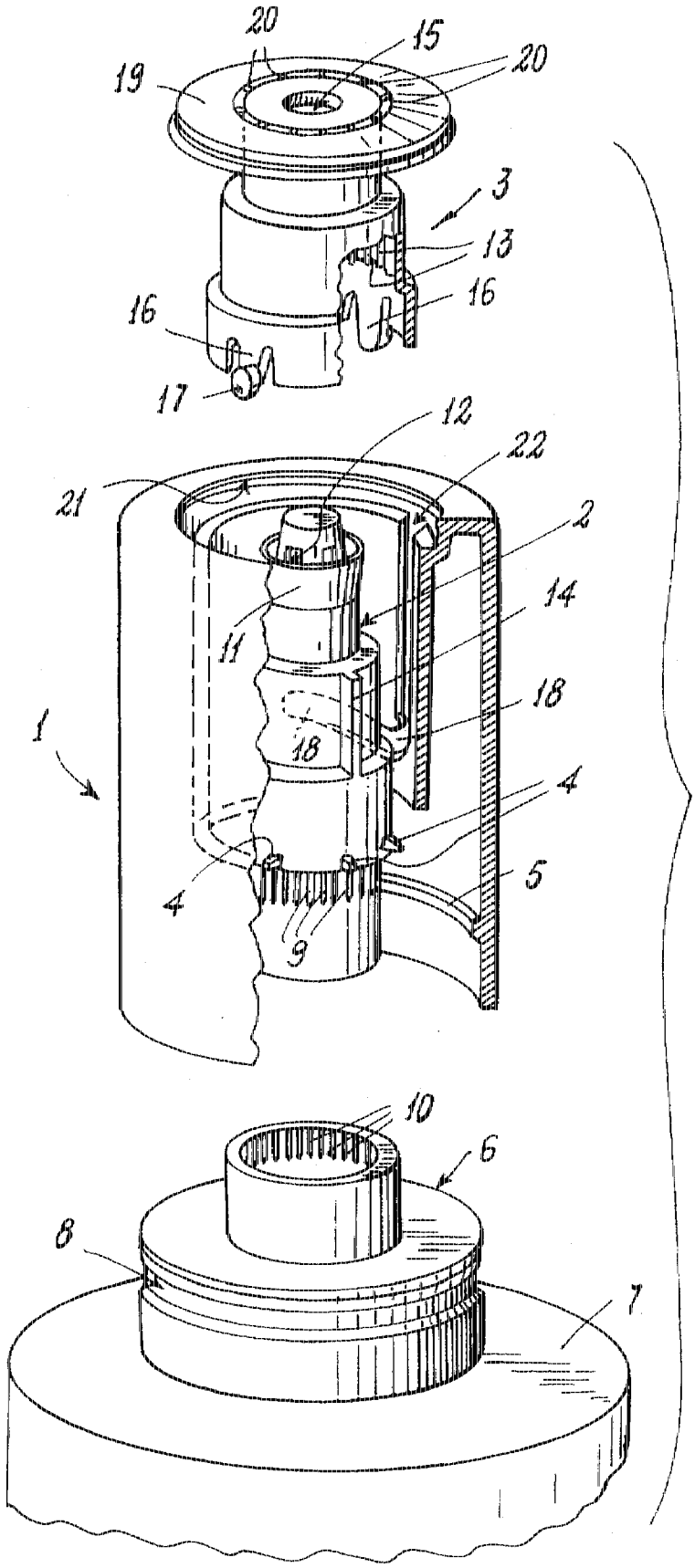

This invention relates to a cap applicable to the mouth of a fluid container, the cap acting as a closure head for the container and being operable to externally deliver said fluid.

Caps of this type are well known and are widely used for dispensing creamy substances (such as liquid soaps), fluid food substances, dense liquids of various kinds and the like.

For example, U.S. Pat. No. 4,690,304 and the equivalent EP-A-0 187 567, U.S. Pat. No. 4,779,764 and the equivalent EP-A-0 270 134, and U.S. Pat. No. 5,104,008 illustrate dispensing caps in the form of two pieces mountable on the mouth of a container and movable axially relative to each other between a position in which an appendix projecting from one of the two pieces is inserted into a discharge hole in the other piece to seal it, and a position in which said discharge hole is withdrawn from said appendix, to enable the fluid to emerge from the container.

The dispensers illustrated in the aforestated patents are of very simple and economical structure but suffer from serious drawbacks, the main one deriving from the fact that in order to be dispensed the fluid has firstly to be poured from the container (which is held inverted with its mouth downwards) into a chamber provided in the dispensing cap, to be then delivered externally through the discharge hole in the cap. Said chamber is of relatively large dimensions such that when the dispensing cap is to be closed, by which the chamber volume is considerably reduced, a part of the dense fluid enclosed within this chamber is expelled to the outside, to be lost and to soil the exterior of the dispenser.

A further drawback of such dispensers is their difficulty of closure, in that the relatively large quantity of dense substance present in the dispenser chamber opposes the closure operation.

To overcome these drawbacks, U.S. Pat. No. 5,004,127 proposes a dispenser cap formed from three separate parts, consisting of an inner part sealedly fixable onto the mouth of a fluid container, an outer part mounted on the container mouth in a manner rotatable about its axis, and an intermediate part constrained to the other two parts such that rotating the outer part causes the intermediate part to translate axially relative to the inner part, to open or close a discharge hole provided in the intermediate part and allow or prevent delivery of the fluid. Again in the case of this cap the container fluid is delivered to the outside after passing through a chamber of relatively large dimensions provided in the cap, such that during closure following dispensing, a part of the fluid (especially if dense) is expelled to the outside through the discharge hole in the dispenser.

A later patent, U.S. Pat. No. 5,421,487 corresponding to EP-A-598223, proposes a dispenser cap conceptually similar to that of U.S. Pat. No. 5,004,127 but in which a continuous annular lip projects from the inner part of the cap to considerably limit the size of the chamber traversed by the fluid before being delivered to the outside. The dispenser of U.S. Pat. No. 5,421,487 has however the drawback that the outer part or skirt (that operable by the fingers of one hand) is not only rotatable about its axis but also moves axially in one direction or another during this rotation, to easily pinch the skin of the fingers of the person operating the cap. Moreover the assembly of the various constituent parts of the cap is very complicated, given that these parts have to be simultaneously fitted together in well defined relative positions, this requiring considerable precision.

The main object of the present invention is to provide a dispenser cap of the aforestated type, which is of economical and simple construction, is easy to assemble, and has only a small-dimension collection chamber for the substance upstream of the discharge hole.

A further object is to provide a dispenser cap which can be constructed in just two parts by moulding and which can be operated by simply rotating an outer skirt, without this also moving axially.

These and further objects are attained by a cap comprising an outer skirt axially traversed by a substantially cylindrical elongate cavity open at both its ends and provided with members for its rotatable application to the mouth of a fluid container, an elongate hollow body positioned in and extending within the skirt cavity and being open at one end and closed at the other, its open end being shaped to be sealedly fixed onto the mouth of said container, and a cup-shaped body superposed on said hollow body and extending into said skirt cavity, the hollow body and the cup-shaped body being provided with mutually cooperating rectilinear guides which enable the cup-shaped body to translate axially relative to the hollow body between a position in which the closed end of the hollow body is sealedly housed in a hole provided in the opposing wall of the cup-shaped body and a position in which said hole has moved away from said closed end of of the hollow body, from which there projects an annular lip which bears against and is sealedly slidable along an opposing cylindrical surface of the cup-shaped body, in the hollow body there being provided at least one aperture situated between said annular lip and the closed end of said hollow body, characterised in that from said cup-shaped body there extends within the skirt cavity at least one flexible arm from which there projects a peg which engages in a helical guide extending along the skirt cavity, the cross-section of the skirt cavity being equal to or greater than the cross-sections of the cup-shaped body, that end of said cup-shaped body close to the closed end of the hollow body being connected by breakable teeth to a disc housed in a shaped seat provided in the skirt in proximity to the corresponding end of the skirt cavity.

Preferably, said hollow body is connected to said skirt by breakable teeth in proximity to the open end of the hollow body.

Figure 2:
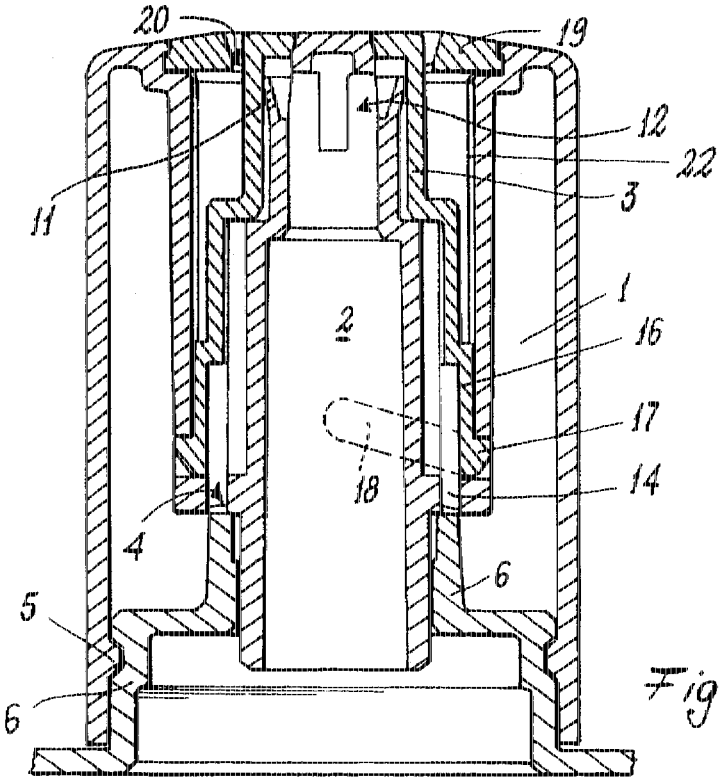
Figure 3:
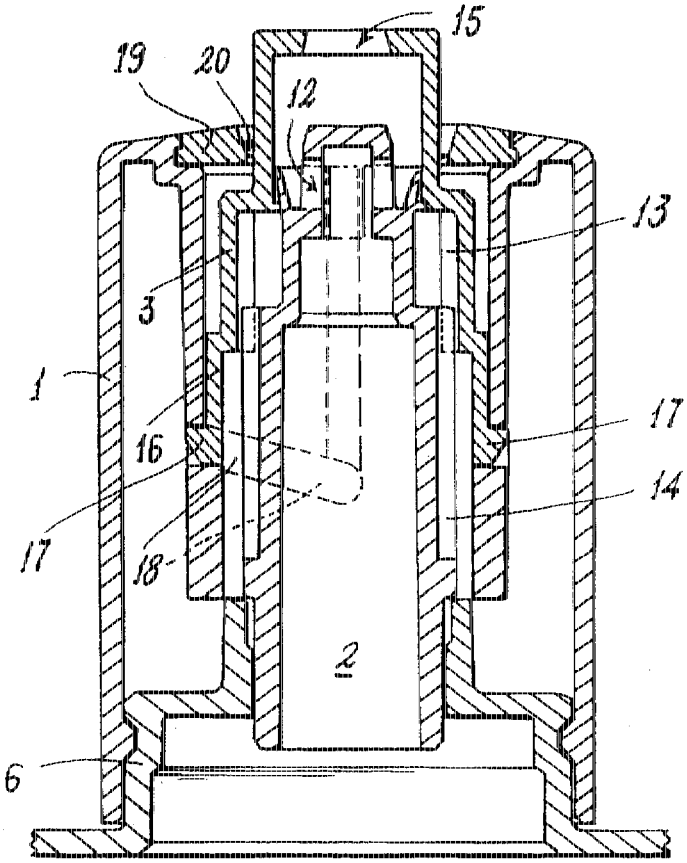

The structure and the characteristics of the dispenser cap will be more apparent from the description of a preferred embodiment thereof given hereinafter by way of non-limiting example with reference to the accompanying drawings, in which:

FIG. 1 is a partly sectional exploded perspective view of the dispenser cap; and FIGS. 2 and 3 are longitudinal sections through the assembled cap, shown in its closed position and open position respectively.

The cap shown in the figures is formed from three parts, namely an outer skirt 1 traversed axially by a cylindrical cavity, an elongate hollow body 2 positioned in and extending within the skirt cavity, and a cup-shaped body 3. The skirt 1 and the hollow body 2 are produced simultaneously in one piece by moulding and are connected together by a plurality of breakable teeth 4.

From the lower portion (with respect to the figures) of the skirt 1 there projects an annular rib 5 which (when the cap is mounted on the mouth 6 of a container 7 containing a fluid to be dispensed by the cap) is inserted into an annular groove 8 on the container mouth 6 such that the skirt is securely fixed to the mouth, but can be freely rotated about its axis relative to the container.

As can be seen from the drawings, the hollow body 2 is closed at its upper end, whereas it is open at its lower end, where it comprises external scoring 9 cooperating with scoring 10 provided on the inside of the free end of the container mouth 6, so that the lower end of the hollow body can be forced into the container mouth (as shown in FIGS. 2 and 3), to remain securely and sealedly fixed into it without it being able to rotate about its axis.

In proximity to the upper end (again with respect to the figures) of the hollow body there projects an annular lip 11, above which there are provided apertures 12 passing through the entire thickness of the hollow body.

The skirt cylindrical cavity receives by insertion (from above) the cup-shaped body 3, which is constrained to the hollow body 2 by rectilinear guides 13 and 14 respectively, these mutually cooperating to allow the free axial translation of the cup-shaped body relative to the hollow body between a cap closure position (FIG. 2) in which the closed upper end of the hollow body is sealedly inserted into a discharge hole provided in the opposing wall of the cup-shaped body, and a position (FIG. 3) in which the hole 15 is raised away from the hollow body, the annular lip 11 of which remains always sealedly slidable against a cylindrical surface provided on the cup-shaped body.

As can be seen in particular from FIG. 1, from the lower end of the cup-shaped body 3 there project two flexible arms 16, from each of which there projects a peg 17 which engages in respective helical grooves 18 provided in the skirt 1 and extending helically along the skirt cavity.

Finally it can be seen that from the upper end of the cup-shaped body 3 there projects a disc 19 which is connected to the body 3 by breakable teeth 20 and is housed and securely retained in a shaped seat 21 (FIG. 1) provided at the upper end of the skirt.

From FIG. 1 it can be seen that the dispenser cap is formed from only two parts produced by moulding a suitable plastics material. To complete the cap the cup-shaped body is inserted from above into the cavity of the skirt 1 such that the pegs 17 slide along rectilinear guides 22 provided in the surface bounding the skirt cavity, to guide the pegs 17 directly into the lowest part (with respect to the figures) of the helical grooves.

The insertion of the cup-shaped body 3 into the skirt cavity proceeds until the disc 19 snap-penetrates into the seat 21 in the skirt, to remain securely locked therein.

At this point the cap can be mounted on the mouth of a container by pressing the open lower end of the hollow body into the mouth, the skirt rib 5 then snapping into the groove 8 in the container mouth.

Certain characteristics of the aforedescribed dispenser cap are particularly important.

One of these is that the cup-shaped body is mounted on the hollow body within the skirt cavity from above, in an extremely simple manner.

A further characteristic is the provision of the disc 19 rigid with the cup-shaped body 3. Besides closing the upper end of the skirt in a virtually perfect manner, this disc constitutes an excellent security seal in that when the cap is operated for the first time to shift it from the closed position (FIG. 2) to the open position (FIG. 3), the axial movement of the cup-shaped body relative to the skirt causes the teeth 20 to break.

It will be noted that the teeth 4 connecting the skirt 1 to the hollow body 2 can act as a further security seal by being broken on initial operation of the cap, although the teeth 4 can be automatically broken on assembling the cap if preferred.

The fact that the bodies 1 and 2 can be formed as a single piece results in an obvious and considerable saving not only in terms of the moulds required for their production, but in particular because automatic machines for mounting these bodies one on the other are not required.

I claim:

1. A cap with a rotatable skirt for dispensing fluids, comprising an outer skirt axially traversed by a substantially cylindrical elongate cavity open at both its ends and provided with members for its rotatable application to the mouth of a fluid container, an elongate hollow body positioned in and extending within the skirt cavity and being open at one end and closed at the other, its open end being shaped to be sealedly fixed onto the mouth of said container, and a cup-shaped body superposed on said hollow body and extending into said skirt cavity, the hollow body and the cup-shaped body being provided with mutually cooperating rectilinear guides, which enable the cup-shaped body to translate axially relative to the hollow body between a position in which the closed end of the hollow body is sealedly housed in a hole provided in the opposing wall of the cup-shaped body and a position in which said hole, has moved away from said closed end of of the hollow body, from which there projects an annular lip which bears against and is sealedly slidable along an opposing cylindrical surface of the cup-shaped body in the hollow body there being provided at least one aperture situated between said annular lip end the closed end of said hollow body, characterised in that from said cup-shaped body there extends within the skirt cavity at least one flexible arm from which there projects a peg which engages in a helical guide extending along the skirt cavity, the cross-section of the skirt cavity being equal to or greater than the cross-sections of the cup-shaped body, that end of said cup-shaped body close to the closed end of the hollow body being connected by breakable teeth to a disc housed in a shaped seat provided in the skirt in proximity to the corresponding end of the skirt cavity.

2. A cap as claimed in claim 1, characterised in that said hollow body is connected to said skirt by breakable teeth in proximity to the open end of the hollow body.

* * * * *